US010843904B2

(12) United States Patent
Gong et al.

(10) Patent No.: US 10,843,904 B2
(45) Date of Patent: Nov. 24, 2020

(54) OFFSHORE CRANE HEAVE COMPENSATION CONTROL SYSTEM AND METHOD USING VISUAL RANGING

(71) Applicant: Zhejiang University, Hangzhou (CN)

(72) Inventors: Guofang Gong, Hangzhou (CN); Yakun Zhang, Hangzhou (CN); Weiqiang Wu, Hangzhou (CN); Xiangping Liao, Hangzhou (CN); Huayong Yang, Hangzhou (CN)

(73) Assignee: Zhejiang University, Hangzhou (CN)

( * ) Notice: Subject to any disclaimer, the term of this patent is extended or adjusted under 35 U.S.C. 154(b) by 246 days.

(21) Appl. No.: 16/064,458

(22) PCT Filed: Dec. 22, 2016

(86) PCT No.: PCT/CN2016/111394

§ 371 (c)(1),
(2) Date: Jun. 21, 2018

(87) PCT Pub. No.: WO2017/107936

PCT Pub. Date: Jun. 29, 2017

(65) Prior Publication Data

US 2018/0370775 A1 Dec. 27, 2018

(30) Foreign Application Priority Data

Dec. 22, 2015 (CN) ..... 2015 1 0969351
Dec. 22, 2015 (CN) ..... 2015 1 0969545
Dec. 22, 2015 (CN) ..... 2015 1 0969833

(51) Int. Cl.
*B66C 13/08* (2006.01)
*B66C 13/16* (2006.01)
(Continued)

(52) U.S. Cl.
CPC ..... *B66C 13/16* (2013.01); *B66C 13/22* (2013.01); *B66C 13/48* (2013.01); *B66C 23/52* (2013.01);
(Continued)

(58) Field of Classification Search
CPC ..... B66C 13/08; B66C 13/10; B66C 13/16; B66C 13/22; B66C 13/46; B66C 23/52;
(Continued)

(56) References Cited

U.S. PATENT DOCUMENTS 6,826,452 B1 * 11/2004 Holland ..... B66C 1/663 318/566
2010/0050917 A1 3/2010 von der Ohe
(Continued)

FOREIGN PATENT DOCUMENTS

CN 101500930 A 8/2009
CN 104817019 B 8/2015
(Continued)

OTHER PUBLICATIONS

Muchun Zou, et al., "Ka[man] filtered wave estimation and prediction of deck rising or falling using visual frequency examination", Modern Manufacturing Engineering, 2010 10, 107-110.

*Primary Examiner* — Emmanuel M Marcelo
(74) *Attorney, Agent, or Firm* — Zhihua Han; Wen IP LLC

(57) ABSTRACT

Provided is an offshore crane heave compensation control system and method using video rangefinding to achieve heave compensation in a directly driven pump-controlled electro-hydraulic heave compensator. The heave compensation and the heave compensator are applicable for special operation and control requirements on a fixed offshore platform and allow the crane to achieve steady lifting of a load away from or lowering of a load on to a supply vessel
(Continued)

without being influenced by the motion of the supply vessel caused by ocean currents, ocean winds, or ocean waves. Also provided is a test platform for the offshore crane heave compensation control system using video rangefinding. The test platform provides a realistic simulation for all lifting and lowering processes of an offshore platform crane in offshore environments to study the motion control of the provided system.

20 Claims, 2 Drawing Sheets

(51) Int. Cl.

| | |
|---|---|
| ***B66C 13/48*** | (2006.01) |
| ***F15B 7/00*** | (2006.01) |
| ***B66C 13/22*** | (2006.01) |
| ***B66C 23/52*** | (2006.01) |
| ***F15B 1/02*** | (2006.01) |
| ***F15B 11/08*** | (2006.01) |
| ***F15B 13/04*** | (2006.01) |
| ***F15B 21/02*** | (2006.01) |

(52) U.S. Cl.
CPC ..... *F15B 1/02* (2013.01); *F15B 7/006* (2013.01); *F15B 11/08* (2013.01); *F15B 13/04* (2013.01); *F15B 21/02* (2013.01); *B66C 2700/085* (2013.01); *F15B 2211/20561* (2013.01); *F15B 2211/212* (2013.01); *F15B 2211/27* (2013.01); *F15B 2211/3051* (2013.01); *F15B 2211/50527* (2013.01); *F15B 2211/633* (2013.01); *F15B 2211/6306* (2013.01); *F15B 2211/6309* (2013.01); *F15B 2211/6336* (2013.01); *F15B 2211/6656* (2013.01); *F15B 2211/7053* (2013.01); *F15B 2211/855* (2013.01)

(58) Field of Classification Search
CPC ... B66C 23/53; B66C 2700/085; F15B 11/08; F15B 13/04; F15B 1/02; F15B 21/02; B63B 27/30; B63B 27/36; B63B 39/00
See application file for complete search history.

(56) References Cited

U.S. PATENT DOCUMENTS

| | | | | |
|---|---|---|---|---|
| 2011/0146556 | A1* | 6/2011 | Yuan ..... | G05D 15/01 114/121 |
| 2014/0107971 | A1* | 4/2014 | Engedal ..... | G01B 21/00 702/150 |
| 2017/0096196 | A1* | 4/2017 | Foo ..... | B63B 27/30 |

FOREIGN PATENT DOCUMENTS

| | | | |
|---|---|---|---|
| CN | 105398961 | B | 3/2016 |
| CN | 105398965 | A | 3/2016 |
| CN | 105417381 | A | 3/2016 |
| CN | 205241072 | U | 5/2016 |
| CN | 205241076 | U | 5/2016 |
| CN | 205419559 | U | 8/2016 |

* cited by examiner

OFFSHORE CRANE HEAVE COMPENSATION CONTROL SYSTEM AND METHOD USING VISUAL RANGING

CROSS REFERENCE TO RELATED APPLICATION

This application is a national stage application of International application number PCT/CN2016/111394, filed Dec. 22, 2016, titled "OFFSHORE CRANE HEAVE COMPENSATION CONTROL SYSTEM AND METHOD USING VISUAL RANGING," which claims the priority benefit of Chinese Patent Application No. CN201510969833.3, filed on Dec. 22, 2015, Chinese Patent Application No. CN201510969351.8, filed on Dec. 22, 2015, and Chinese Patent Application No. CN201510969545.8, filed on Dec. 22, 2015 which are hereby incorporated by reference in its entirety.

TECHNICAL FIELD

The present disclosure involves a mechanical field, specifically involves an offshore crane heave compensation control system and method using visual ranging.

BACKGROUND

Since the 21st century, the global demand for energy is increasing, so that the ocean has become priority in energy strategy for every country. All the countries around the world have made great efforts to develop the marine resources. With the development of offshore oil, the large-scale offshore engineering is also booming. No matter which way you do the offshore mining, the exploitation of marine resources must be based on offshore platforms. The offshore crane is absolutely necessary for the offshore engineering construction. Offshore platforms can be divided into two types: fixed offshore platforms and floating offshore platforms When a land crane is lifting load, the relative position between the crane body and the platform for the load to be lifted is constant. But in an open marine environment, the situation is quite different. Ye Jian (Research on control strategy of active heave compensation system in the use of shipping supplies [D]. Wuhan University of Technology, 2013) mentioned that in a very tough marine environment, due to ocean currents, sea wind or ocean waves, vessels and floating offshore platforms generated six degree-of-freedom (6-DOF) motions (including heaving, heeling, pitching, swaying, surging and yawing). The heaving, heeling and pitching are the major factors that affect the deep-sea operation. Various operating systems and auxiliary systems connected to the vessels and floating offshore platforms will heave while the vessels and floating offshore platforms heave. When offshore crane heave is working, the situation can be divided into three categories: transporting from a swaying platform to a fixed platform, transporting from a fixed platform to a swaying platform, transporting from a swaying platform to a swaying platform. Zhao Rui (Research on active wave compensation crane control cystem [D]. Jiangsu University of Science and Technology, 2013) mentioned that the main disadvantage that the ocean currents, sea wind or ocean waves affect offshore crane operation including the two aspects: firstly, they cause collision between the cargo and platform while the cargo is going down and the platform suddenly going up. Or the cargo which has just been placed in the platform suddenly becomes hanging in the air but the platform is suddenly going down; secondly, they cause great change to the tension of the crane wire rope, resulting in rapid shrinkage or stretching of the wire rope, thereby causing wire rope breakage or damage to the operating equipment. It will reduce the lifting accuracy and increase the risks of operations; in addition, it will generate additional dynamic loads in the structure, causing equipment damage and personnel death in serious cases. Compared to land cranes, offshore cranes are more difficult to operate safely and efficiently. For offshore cranes, the effects of heaving, heeling and pitching motions should be eliminated while land cranes don't need to that.

In the prior art, the main technologies used to eliminate the impact of ocean currents, ocean winds or ocean waves on the crane operation are the constant tension technology and heave compensation technology, which are developed for ship-mounted cranes and floating offshore platform. The constant tension technology is mainly used to avoid the loss of tension or impact on loads caused by heave motion of ocean waves of the wire rope during the lifting process, so that the lifted objects can move up and down with the ocean waves. When moving to the peak, it is lifted off the deck or the sea surface. For example, Christson SG (A constant-tension winch system for handling rescue boats [J]. Marine Technology and SNAME News, 1988, 25(3): 220-228) developed and tested the PD12C-CT constant-tension winch system. The system used the remote pressure regulating overflow valve to maintain the constant pressure difference between the motor inlet and outlet, so as to maintain the constant tension of the winch. Xu Wei et al. (Design and Simulation Study of Constant Tension System for Vessel Cranes [J]. Equipment Manufacturing Technology, 2012, (5):13-15) believed that the constant tension technology can only work during the lifting stage to avoid the impact loads caused by heave motion of vessel to the mooring ropes when lifting people or cargos, but it cannot avoid the impact loads on people or cargo caused by the motion of ocean waves when people or cargo is lowered onto the supply vessel deck.

Ye Jian (Research on Control Strategy of Active Heave Compensation System for Ship Lifting and Recharging [D]. Wuhan University of Technology, 2013) mentioned that the heave compensation technology can be divided into passive heave compensation technology and active heave compensation technology according to the power supply mode. When there is relative motion between two vessels that are complementary to each other and the tension of the measuring device caused by motion deviates from the preset tension value, and the passive heave compensator operates. The power source of the passive heave compensation comes from the heave motion of vessels, which needs not additional power. However, passive heave compensation technology has the following drawbacks: its compensation ability depends on the size of the accumulator pressure. The compensation range is determined by the stroke of the cylinder piston rod, and the compensation speed depends on the flow rate input to the hydraulic cylinder. Therefore, the passive heave compensator usually has a large size, a large compensation lag, poor compensation adaptability and unstable compensation performance, it's difficult to adapt to complicated and variable ocean conditions. The major difference between active heave compensation and passive heave compensation is the introduction of the vessel Motion Reference Unit (MRU), the vessel motion signals are introduced to closed-loop motion control of the active heave compensation hydraulic cylinder through a feedforward way. Active heave compensation technology is mainly composed of detection elements, control elements and actuating elements. The vessel motion signals measured by the Motion Reference Unit (MRU) control the active compensation cylinder to produce motions that have same amplitude and speed but opposite direction of the vessel heave motion, to achieve the compensation of the vessel heave motion. The active heave compensation system pre-detects the ship motion signals and the controller adjusts the compensation parameters. Therefore, it has a large compensation range, good adaptability, high compensation accuracy, stable compensation performance and good operation safety. The core of the active heave compensation system is its control system. It is required to design a perfect control system, so that it can accurately detect the motion attitude of the vessel and feed back to the control system, then the control system accurately drives the actuating mechanism to complete the heave compensation action of vessels.

The main tasks of shipborne offshore cranes are replenishment of marine supplies, retraction of lifeboats, and underwater operations. In addition to installing the heave compensator on the vessel crane, a vessel Motion Reference Unit (MRU) should be mounted on the supplied vessel during the replenishment of the marine cargos. The MRU may be a displacement sensor or a binocular camera system installed on the deck of the supplied vessel (Zeng Zhigang. Experimental study on key issues of wave motion heave compensation hydraulic platform [D]. South China University of Technology, 2010; Zou Muchun, Liu Guixiong. KALMAN filter estimation and prediction of deck heave with video detection [J]. Modern Manufacturing Engineering, 2010, 10: 107-110), to detect the displacement of the deck. The distance between supply vessel and supplied vessel is short, usually from a few meters to over a dozen meters. Generally the real-time data collected by supplied vessel are continuously transmitted to the data processing unit installed on the supply vessel via a wireless communication system. The data processing unit detects the relative motion speed or heave displacement of two vessel platforms in the vertical direction caused by ocean waves and other factors through the real-time data collected by the supply vessel and supplied vessel, and the measured results are transmitted to the computer control system.

When a shipborne crane is carrying out the lifeboat retraction, Wang Shenghai (Research on Design of Vertical Active Wave Compensation Control System [D]. Dalian Maritime University, 2013) installs the heave compensator in a shipborne crane. The vessel Motion Reference Unit (MRU), acoustic wave meter, rotation speed sensor and tension sensor compose the sensor network. MRU can measure the vessel motion, the acoustic wave meter and MRU coupling can measure the wave motion, the rotation speed sensor can measure the rotation of drums to obtain the lifeboat motion state, and the tension sensor can sense the tension of the rope. The signals measured by the sensor network are transmitted to the nearby wave compensation controller, and the controller performs analysis and calculation, sends out control signals to control the speed and steering of the drum, to realize the wave compensation process for lifeboat retraction and offset the influence of vessel motion on lifeboat retracting operation.

According to the Chinese patent CN103626068A, when a ship-borne crane is performing underwater operations, the heave compensator is installed on the ship-borne crane. The hoisting drum hoists a load through the wire rope bypassing the suspension fulcrum at the front end of the support arm, and the load is immersed under the water. The vessel attitude motion sensor (its function is equivalent to MRU) can detect the vessel heave motion in a real-time manner. The absolute encoder can detect the motion of hoisting drum in a real-time manner. The tension sensor can detect the dynamic tension of the wire rope in a real-time manner. The compensator is connected to the vessel attitude motion sensor, the absolute encoder and tension sensor. The compensator can calculate the prediction parameters based on the historical data and the real-time detected data of the vessel's heave motion, the motion of hoisting drum and the dynamic tension of the wire rope, and apply a compensation voltage on the hoisting drum based on the predictive parameters, to achieve the purpose of controlling the motion of the hoisting load and maintaining the load at a constant position in the water.

According to US patent US2010/0050917A1, when an offshore floating platform crane is performing drilling operation, the heave compensator is installed on drilling rack of offshore floating platform. The volume difference between two sides of the differential cylinder is compensated by a hydraulic closed loop circuit and an accumulator, the heave motion of the floating platform is detected by a Motion Reference Unit (MRU), the expansion and contraction of the hydraulic cylinder is detected by a displacement sensor, and the pressure on both side of the pump is detected by a pressure sensor, so that the drilling vessel remains stable on the sea floor during drilling and is not affected by the sea surface wave heave.

In the daily work, the life materials for staffs, equipment maintenance and replacement and household garbage disposal in the fixed offshore platform must be transported by a supply vessel. The fixed offshore drilling platform is nearly a hundred meters above the sea surface, and these cargos are lifted from the supply vessel to the fixed offshore platform, or lowered from the offshore platform to the supply vessel, all of which are completed by the fixed offshore platform crane. The operating capacity of fixed offshore platform crane is greatly limited by heave motion and swing of vessel caused by motions of ocean currents, ocean winds or ocean waves. When the fixed offshore platform crane is operating, the crane hook is connected to the lifted cargo and the wire rope lifts or lowers the cargos by the lifting force. When the cargo is lifted from the supply vessel deck to the offshore platform, if the vessel rises with the ocean waves during the lifting phase (the wire rope is tensioned), the tension on the wire rope disappears, the wire rope bends, then the vessel descends with the ocean waves. The wire rope is tensioned again. Because the ocean waves have great heave (usually 3 to 5 m) and the lowering speed is faster, the cargos will produce impact loads on the wire rope when falling away the vessel deck, causing the entire crane to vibrate, increasing the operating risks, and even causing equipment damage and personnel casualties in serious circumstances. When the cargo is lowered from the fixed offshore drilling platform to the supply vessel, it is also affected by the heave motion of the vessel, which cannot guarantee the positioning accuracy of the lifting and may generate collision between the cargo and vessel deck and the impact load of the wire rope. At present, the lifting and lowering of the fixed offshore drilling platform crane are operated by a crane driver, and the crane driver's cab is located on the top of the platform crane, which is about 100 meters from the sea surface. The driver has difficulty in judging the right time for lifting and lowering, so the above vibration and collision may occur in the daily operation, which brings a great challenge to the safety production and equipment life, difficult to achieve smooth lifting and lowering of cargos between the fixed offshore platform and the supply vessel.

Although the tasks of a fixed offshore platform crane, a shipborne crane and a floating offshore platform are similar, there are great differences in the specific use environment and the motion compensation method for the fixed offshore platform in comparison with the shipborne crane and the floating offshore platform. The solutions of shipborne crane and the floating offshore platform cannot be applied to the fixed offshore platform crane. To eliminate the impact of motions of ocean currents, ocean winds or ocean waves on the operation of fixed offshore platform crane, if a constant tension technology is used, it cannot solve the problems during the lowering stage but it only works in the lifting stage. The fixed offshore platform crane needs to be used for lifting cargos and lowering the cargos steadily to the supply vessel, including two processes: lifting and lowering. The constant tension technology can only solve half of the technical problems. If the heave compensation technology is adopted, a device for detecting the vessel motion signals (MRU) needs to be installed on each supply vessel. In order to achieve the motion compensation control, it is further necessary to solve the problem of wireless communication between the detected vessel motion signals and the fixed offshore platform. In the application scenarios of shipborne cranes and floating offshore platform, the vessel Motion Reference Unit (MRU) or the motion sensor are installed on the supply vessel (floating platform) and the supplied vessel, respectively, and the distance between the supply vessel (floating platform) and the supplied vessel is relatively short (usually in the range of several meters to around ten meters), so it is feasible to realize signal transmission through wireless communication way. However, for the fixed offshore platform crane, there are a large number of supply vessels coming and going. It is not practical to install a vessel Motion Reference Unit (MRU) or sensor on each supply vessel. On the one hand, the supply vessel cannot be the same vessel. If a MRU or a motion sensor is installed on every supply vessel, the cost is very high. On the other hand, even if a MRU or a motion sensor is installed, the transmission of signals is achieved by means of wireless communication because the horizontal and vertical distance between the fixed offshore platform crane and the supply chain is very large (at least nearly 100 meters). This technique requires each of the supply vessels to be equipped with transmitting equipmen, as well as the installation of receiving equipment on the offshore platform, it is too expensive and difficult to implement in practice.

No control system is available for special operation and control requirements on a fixed offshore platform crane, to allow the crane to achieve steady lifting of a load away from or lowering of a load on to a supply vessel without being influenced by the motion of the supply vessel caused by ocean currents, ocean winds, or ocean waves.

Furthermore, for the existing active heave compensation technology, its hydraulic system adopts a valve-controlled open circuit. A hydraulic oil source needs to be equipped to allow the hydraulic valve group to work. It is bulky and has complicated piping connections with many components; moreover, due to throttling loss, the entire system has a very low efficiency.

SUMMARY

Aimed at the shortages of existing technology and the technical problem, the present disclosure provides an offshore crane heave compensation control system and method using visual ranging, as to achieve heave compensation in offshore crane. The heave compensation is adequate for special operation and control requirements on a fixed offshore platform. Under the condition of the ocean currents, sea wind or ocean waves, the system helps the offshore crane to achieve loading up and down the cargo steadily to a supply vessel without being influenced by the heave motion of the supply vessel. The disclosure also provides a testbed for the offshore crane heave compensation control system using visual ranging. The testbed simulates the whole process when the offshore crane is loading down and up cargo to the supply vessel with the real environment, as to study the offshore crane heave compensation control system using visual ranging The specific technical scheme of the disclosure is as follows:

One object of the present disclosure is to provide an offshore crane heave compensation control system using visual ranging.

The control system includes a detecting device, a controlling device, and an actuating device. The heave compensation control system is to achieve heave compensation movement automatically while the offshore crane is loading down and up cargo to the supply vessel, by adding the movement of supply vessel with the same direction and amplitude to the offshore crane. In order to load down and up the cargo to the supply vessel stably, under the condition of ocean waves, the offshore crane can achieve loading down and up the cargo to a supply vessel without being influenced by the heave motion caused by the ocean currents, sea wind or ocean waves; wherein:

The detecting device detects the three-dimensional position information of the supply vessel using visual ranging method, transmits the detected parameters of three-dimensional position information to the controlling device, the controlling device controls the actuating device to achieve heave compensation movement automatically while the offshore crane is loading down and up cargo to the supply vessel, by adding the movement of supply vessel with the same direction and amplitude to the offshore crane. In order to load down and up the cargo to the supply vessel stably, under the condition of ocean waves, the offshore crane can achieve loading down and up the cargo to a supply vessel without being influenced by the motion caused by the ocean currents, sea wind or ocean waves;

The offshore platform is a fixed offshore platform.

The three-dimensional position information means displacement, velocity and acceleration information in various directions which is referred to a rectangular coordinate system including the heave direction and the three-dimensional attitude of the supply vessel.

The movement with the same amplitude and same direction means the supply vessel motion along with the periodic motion of the ocean waves with the same amplitude and same direction.

In some embodiments, during the loading up stage, the detecting device detects the heave motion information of the supply vessel using visual ranging method, and the controlling device computes the velocity and acceleration information of the supply vessel. The actuating device adds the motion of the same amplitude and the same direction of the supply vessel heave motion to perform active heave motion compensation and choose the right time to load up, as to avoid the impact loads of the crane wire ropes and achieve loading up the load steadily.

In some embodiments, during the loading down stage, the detecting device detects the three-dimensional position information of the supply vessel using a visual ranging method. Under the control of the controlling device, the actuating device adds the motion of the same amplitude and the same direction of the supply vessel heave motion during the loading down stage, to ensure that the load is down to the vessel deck at a relative setting speed. Furthermore, the supply vessel attitude information can be judged, the right time to loading down can be selected, as to achieve loading down the load steadily.

In some embodiments, the actuating device is a direct pump control electro-hydraulic heave compensation device which includes a servo motor driver, a rotation speed sensor, a displacement sensor, and an at least three pressure sensors. The servo motor driver drives the direct pump control electro-hydraulic heave compensation device. The rotation speed sensor, built-in displacement sensor, and at least three pressure sensors collect the operating parameters of the direct pump control electro-hydraulic heave compensation device and feed them back to the control system, as to achieve a closed-loop control of the direct pump control electro-hydraulic heave compensation device, in order to loading down and up the load steadily and stably.

The closed-loop control means that the information collected by the sensor feed back to the controlling device, after compared to the input instruction signal, it controls the direct pump control electro-hydraulic heave compensation device precisely. We use the displacement sensor to control the displacement or speed of closed-loop precisely. We use the pressure sensor is used to control force precisely.

In some embodiments, the actuating device is a direct pump control electro-hydraulic heave compensation device which includes a servo motor driver, a servo motor, a two-way hydraulic pump, an accumulator, and a quick connector, two overflow valves, a single rod hydraulic cylinder, a movable pulley, a static pulley, at least three pressure sensors, a rotation speed sensor, and a displacement sensor. The servo motor driver drives the servo motor to rotate the two-way hydraulic pump. Two output terminals of the two-way hydraulic pump are connected to a rod chamber and a rodless chamber of the single rod hydraulic cylinder respectively through the hydraulic pipeline. Two oppositely mounted overflow valves are connected in parallel between the two output terminals of the two-way hydraulic pump. The servo motor is connected to the rotation speed sensor. The rotation speed sensor, the displacement sensor, servo motor driver, and at least three pressure sensors are respectively connected to the control computer. The movable pulley is connected to the piston rod of the single rod hydraulic cylinder. The static pulley is connected to the bottom of the single rod hydraulic cylinder. The displacement sensor is installed in the single rod hydraulic cylinder.

In some embodiments, the servo motor driver, the servo motor, the two-way hydraulic pump, the accumulator, the quick connector, the two overflow valves, the single rod hydraulic cylinder, the movable pulley, the static pulley, at least three pressure sensors, the rotation speed sensor, and displacement sensor are integrated into an autonomous device.

In some embodiments, the movable pulley, the piston rod of the single rod hydraulic cylinder and the static pulley of the direct pump control electro-hydraulic heave compensation device are located on the same axis.

In some embodiments, after the first way of the accumulator of the direct pump control electro-hydraulic heave compensation device is connected to one terminal of two oppositely mounted pilot operated check valve, the other terminal of the two oppositely mounted pilot operated check valve is connected in parallel between the two terminals of the two-way hydraulic pump.

In some embodiments, the accumulator is divided into three ways, the first way is connected to the rod chamber side of the single rod hydraulic cylinder, the second way is connected to the quick connector, and the third way is connected to the first pressure sensor, the two output terminals of the two-way hydraulic pump are connected to the second pressure sensor and the third pressure sensor.

In some embodiments, the controlling device is a control computer, the detecting device is an industrial camera, the actuating device is a directly-driven pump-controlled electro-hydraulic heave compensator; the industrial camera and the direct pump control electro-hydraulic heave compensation device are connected to the control computer via electrical connection wiring respectively, the industrial camera and the direct pump control electro-hydraulic heave compensation device are respectively mounted on an offshore crane base. The information and energy exchange between the direct pump control electro-hydraulic heave compensation device and the control computer, which form a closed-loop motion control, in order to loading down and up the load steadily and stably.

In some embodiments, the displacement sensor is a built-in displacement sensor.

The second object of the present disclosure is to provide a control method of an offshore crane heave compensation control system using visual ranging as described above, wherein the control method includes the following steps: detects three-dimensional position information of a supply vessel by a detecting device using visual ranging method, transmits the detected parameters to a controlling device to control the actuating device to perform heave motion compensation of the entire process of offshore crane while loading up and down the load, and adding the same amplitude and the same direction of heave motions of a supply vessel to the offshore crane during the loading up and down processes. Under the conditions of ocean wave motions, it guarantees that the offshore crane is not affected by the heave motion of the supply vessel, in order to loading down and up the load steadily and stably In some embodiments, the control method includes the loading down stage and the loading down stage:

In some embodiments, during the loading up stage, the detecting device detects the heave motion information of the supply vessel using visual ranging method, and the controlling device computes the velocity and acceleration information of the supply vessel. The actuating device adds the motion of the same amplitude and the same direction of the supply vessel heave motion to perform active heave motion compensation and choose the right time to life, as to avoid the impact loads of the crane wire ropes and achieve a steady lifting.

In some embodiments, during the loading down stage, the detecting device detects the three-dimensional position information of the supply vessel using a visual ranging method. Under the control of the controlling device, the actuating device adds the motion of the same amplitude and the same direction of the supply vessel heave motion during the loading down stage, to ensure that the load is down to the vessel deck at a relative setting speed. In some embodiments, the supply vessel attitude information can be judged, the right time to loading down can be selected, as to achieve loading down the load steadily.

In some embodiments, the actuating device is a direct pump control electro-hydraulic heave compensation device, the detecting device is an industrial camera, and the control device is a control computer.

The third object of the present disclosure is to provide a testbed for the offshore crane heave compensation control system using visual ranging as described before. The testbed includes a hydraulic oil source, a hydraulic control valve, a control handle, a hydraulic winch, an actuating device, a controlling device, a detecting device, a rack, a simulated load, a 6-DOF platform, a control cabinet for power distribution and a tension sensor. The actuating device and the detecting device are installed on the rack, one terminal of the wire rope is connected to the simulated load via the actuating device, the other terminal of the wire rope is connected to the hydraulic winch, and the hydraulic control valve is connected to the hydraulic oil source, the control handle and the hydraulic winch respectively. The simulated load is loaded up and down by the control handle. The simulated load is placed on the 6-DOF platform, the 6-DOF platform and the control cabinet for power distribution combine together to simulate the vessel motion on the ocean. The control cabinet for power distribution, actuating device and detecting device are connected with the controlling device respectively.

In some embodiments, the actuating mechanism is a direct pump control electro-hydraulic heave compensation device, including a servo motor driver, a rotation speed sensor, a displacement sensor, and at least three pressure sensors.

In some embodiments, the actuating device is a direct pump control electro-hydraulic heave compensation device includes a servo motor driver, a servo motor, a two-way hydraulic pump, an accumulator, and a quick connector, two overflow valves, a single rod hydraulic cylinder, a movable pulley, a static pulley, at least three pressure sensors, a rotation speed sensor, and a displacement sensor. The servo motor driver drives the servo motor to rotate the two-way hydraulic pump. Two output terminals of the two-way hydraulic pump are connected to a rod chamber and a rodless chamber of the single rod hydraulic cylinder respectively. Two oppositely mounted overflow valves are connected in parallel between the two output terminals of the two-way hydraulic pump; the servo motor is connected to the rotation speed sensor. The rotation speed sensor, displacement sensor, servo motor driver, and at least three pressure sensors are respectively connected to the control computer; the movable pulley is connected to the piston rod of the single rod hydraulic cylinder, the static pulley is connected to the bottom of the single rod hydraulic cylinder, and the displacement sensor is installed in the single rod hydraulic cylinder.

In some embodiments, the servo motor driver, the servo motor, the two-way hydraulic pump, the accumulator, the quick connector, the two overflow valves, the single rod hydraulic cylinder, the movable pulley, the static pulley, at least three pressure sensors, the rotation speed sensor, and displacement sensor are integrated into an autonomous device.

In some embodiments, the displacement sensor is a build-in displacement sensor.

In some embodiments, the controlling device is a control computer, the detecting device is an industrial camera, and the actuating device is a direct pump control electro-hydraulic heave compensation device. The industrial camera and the direct pump control electro-hydraulic heave compensation device are connected to the control computer via electrical connection wiring respectively.

In some embodiments, the sensor group, the industrial camera, and the servo motor driver in the direct pump control electro-hydraulic heave compensation device are connected to the control computer respectively.

In some embodiments, one terminal of the wire rope is connected to a simulated load through a static pulley, a movable pulley and a tension sensor in the direct pump control electro-hydraulic heave compensation device, and the other terminal of the wire rope is connected to a hydraulic winch.

In some embodiments, the sensor group includes a rotation speed sensor, a displacement sensor, and at least three pressure sensors.

The fourth object of the present disclosure is to provide a direct pump control electro-hydraulic heave compensation device of the offshore crane heave compensation control system using visual ranging. The direct pump control electro-hydraulic heave compensation device is the actuating device of the offshore crane heave compensation control system. The direct pump control electro-hydraulic heave compensation device includes a servo motor driver, a servo motor, a two-way hydraulic pump, an accumulator, a quick connector, two overflow valves, a single rod hydraulic cylinder, a movable pulley, a static pulley, at least three pressure sensors, a rotation speed sensor, and a displacement sensor. The servo motor driver drives the servo motor to rotate the two-way hydraulic pump. Two output terminals of the two-way hydraulic pump are connected to a rod chamber and a rodless chamber of the single rod hydraulic cylinder respectively. Two oppositely mounted overflow valves are connected in parallel between the two output terminals of the two-way hydraulic pump; the servo motor is connected to the rotation speed sensor. The rotation speed sensor, displacement sensor, servo motor driver, and at least three pressure sensors are respectively connected to the control computer; the movable pulley is connected to the piston rod of the single rod hydraulic cylinder, the static pulley is connected to the bottom of the single rod hydraulic cylinder, and the displacement sensor is installed in the single rod hydraulic cylinder.

In some embodiments, the servo motor driver, servo motor, two-way hydraulic pump, accumulator, quick connector, two overflow valves, single rod hydraulic cylinder, movable pulley, static pulley, at least three pressure sensors, rotation speed sensor, and displacement sensor are integrated into an autonomous device.

In some embodiments, the movable pulley, the piston rod of the single rod hydraulic cylinder and the static pulley of the direct pump control electro-hydraulic heave compensation device are located on the same axis.

In some embodiments, after the first way of the accumulator of the direct pump control electro-hydraulic heave compensation device is connected to one terminal of two oppositely mounted pilot operated check valve, the other terminal of the two oppositely mounted pilot operated check valve is connected in parallel between the two terminals of the two-way hydraulic pump.

In some embodiments, the displacement sensor is a build-in displacement sensor.

The present invention can achieve the following beneficial effects:

1) The present invention detects the three-dimensional position information of a supply vessel using a visual ranging method, and transmits these parameters to the control computer to control the direct pump control electro-hydraulic heave compensation device, performs intelligent heave motion compensation of offshore crane, guarantees that the crane can achieve steady lifting of a load away from or lowering of a load on to a supply vessel deck without being influenced by the heave motion of the supply vessel caused by ocean waves, to perform heave motion compensation of the entire process of crane lifting and lowering. It has a compact structure, simple system, is convenient to use and maintain, with extensive practicality and advanced nature. The present invention also can be applied to heave compensation of shipborne equipment and quay cranes.

2) The present invention constitutes an autonomous device by using a directly driven pump-controlled differential cylinder closed loop circuit, integrating a servo motor, a hydraulic element and a sensor. The control computer performs closed-loop control, to realize the electromechanical-hydraulic integrated design, greatly reducing the number of components and the volume of devices, without throttling loss; in addition, it can achieve energy recovery, significantly enhancing the energy efficiency. It has a compact structure, simple system, is convenient to use and maintain, with extensive practicality and advanced nature.

3) The present invention simulates the motion of a vessel in a marine environment through a 6-DOF platform, detects the motion parameters of the 6-DOF platform using an industrial camera, and transmits these parameters to a computer to construct a closed-loop control structure of offshore crane heave compensation motion control system using visual ranging. By collecting hydraulic system operation parameters, 6-DOF platform attitude, wire rope impact, and operation parameters of heave compensator, the system operation is monitored in an all-round way, to conveniently carry out the testing of offshore crane heave compensation motion control system and the simulation and testing of the operating process of conventional offshore cranes using visual ranging. Through detection on the tension of wire rope, the control performance of the offshore crane heave compensation motion control system using visual ranging can be judged, and compared with conventional offshore cranes, to study the control strategy of the offshore crane heave compensation motion control system using visual ranging The test platform has compact structure, is convenient to use, with extensive practicality. The present invention can also be applied to the testing and research of heave compensators of shipborne equipment and quay cranes.

NOTES

1, control computer; 2, industrial camera; 3, direct pump control electro-hydraulic heave compensation device; 4, servo motor driver; 5, rotation speed sensor; 6, pressure sensor; 7, built-in displacement sensor; 8, electrical connection wiring; 9, movable pulley; 10, static pulley; 11, single rod hydraulic cylinder, 12, hydraulic pipeline, 13, accumulator, 14, quick connector, 15, overflow valve, 16, servo motor, 17, two-way hydraulic pump, 18, Pilot operated check valve, 19, hydraulic oil source, 20, hydraulic control valve, 21, control handle, 22, hydraulic winch, 23, hydraulic pipeline, 24, wire rope, 25, tension sensor, 26, simulated load, 27, 6-DOF platform, 28, sensor group, 29, control cabinet for power distribution, 30, rack.

DETAILED DESCRIPTION OF THE PREFERRED EMBODIMENTS

The present invention will be In some embodiments described below with reference to the accompanying drawings and embodiments. The following embodiments are only used to illustrate the present invention and are not used to limit the scope of the present invention. In addition, it should be understood that after reading the contents described in the present invention, those skilled in the art can make various changes or modifications to the present invention, and these equivalent forms also fall within the scope defined by the appended claims of the present application.

Embodiment 1

Figure 1:
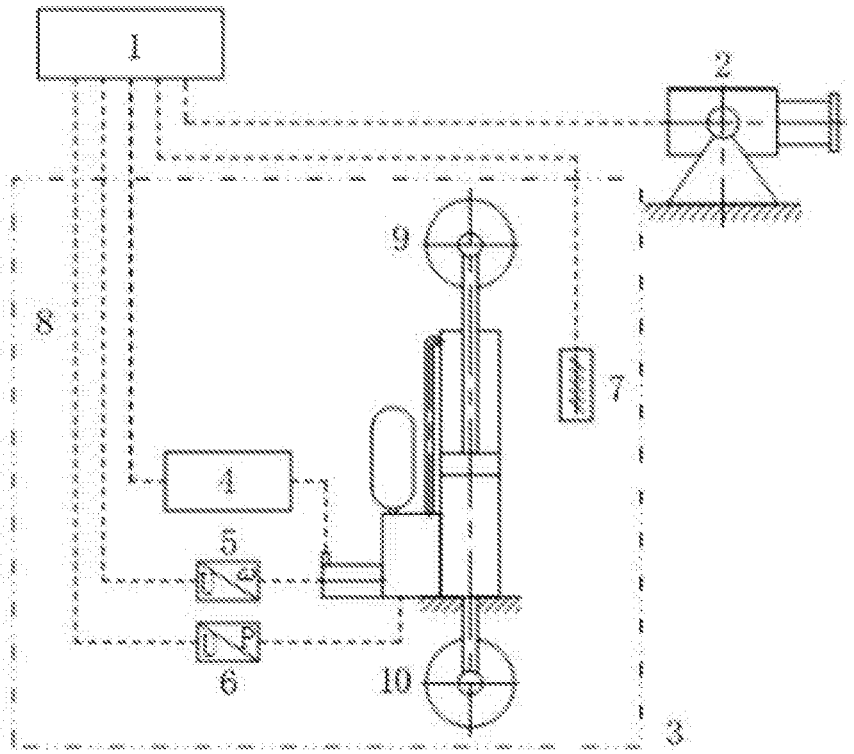
FIG. 1 is a structural diagram of an offshore crane heave compensation control system using visual ranging.

Referring to FIG. 1, the offshore crane heave compensation control system using visual ranging in the present invention includes a control computer 1, an industrial camera 2 and direct pump control electro-hydraulic heave compensation device 3. The industrial camera 2 and the servo motor driver 4, rotation speed sensor 5, three pressure sensors 6 and built-in displacement sensor 7 in the direct pump control electro-hydraulic heave compensation device 3 are respectively connected to the control computer 1 via electrical connection wiring 8 to exchange information and energy; the industrial camera 2 and the direct pump control electro-hydraulic heave compensation device 3 are respectively mounted on the offshore crane base.

Figure 2:
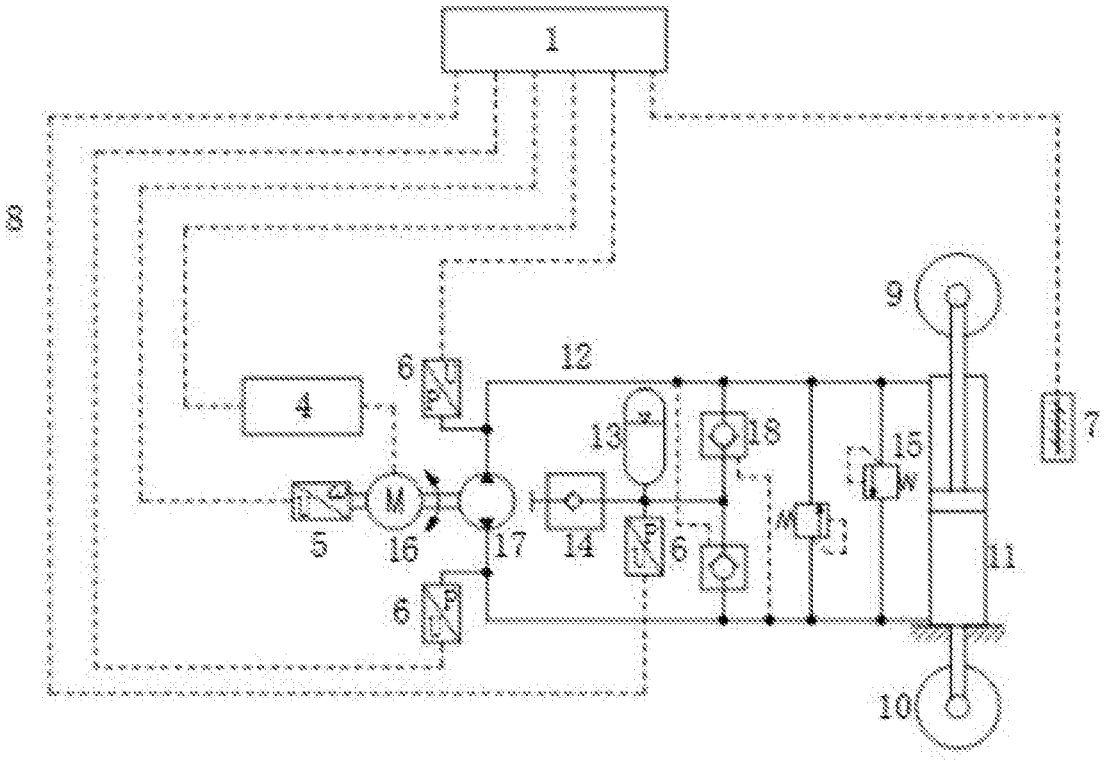
FIG. 2 is a structural diagram of a direct pump control type electro-hydraulic heave compensation device according to example 1.

Referring to FIG. 2, the direct pump control electro-hydraulic heave compensation device 3 in the first embodiment includes a servo motor driver 4, a servo motor 16, a two-way hydraulic pump 17, an accumulator 13, a quick connector 14, two overflow valves 15, a single rod hydraulic cylinder 11, a movable pulley 9, a static pulley 10, three pressure sensors 6, a rotation speed sensor 5, and a displacement sensor 7.

The servo motor driver 4 drives the servo motor 16 to rotate the two-way hydraulic pump 17. Two output terminals of the two-way hydraulic pump 17 are connected to a rod chamber and a rodless chamber of the single rod hydraulic cylinder 11 respectively through the hydraulic pipeline 12. The two output terminals of the two-way hydraulic pump 17 are in parallel with two overflow valves 15 which are reverse installed; The accumulator 13 is divided into three ways, the first way is connected to the rod chamber side of the single rod hydraulic cylinder 11, the second way is connected to a quick connector 14, and the third way is connected to the first pressure sensor 6, the two output terminals of the two-way hydraulic pump 17 are connected to the second pressure sensor 6 and the third pressure sensor 6. The servo motor 16 is connected to the rotation speed sensor 5. The rotation speed sensor 5, the built-in displacement sensor 7, the servo motor driver 4, and three pressure sensors 6 are respectively connected to the control computer 1 via electrical connection wiring 8. The movable pulley 9 is connected to the piston rod of the single rod hydraulic cylinder 11. The static pulley 10 is connected to the bottom of the single rod hydraulic cylinder 11. The static pulley 10 is located at the same axis as the movable pulley 9. The movable pulley 9 and the static pulley 10 are connected to the crane lifting wire rope. The built-in displacement sensor 7 is installed in the single rod hydraulic cylinder 11.

The servo motor 16, the two-way hydraulic pump 17, the single rod hydraulic cylinder 11, the accumulator 13, the overflow valve 15, the quick connector 14, the three pressure sensors 6, the rotation speed sensor 5, the built-in displacement sensor 7 and the two Pilot operated check valve 18 are integrated into an autonomous system. The system doesn't need any hydraulic oil source, reduces the number of components and the volume of devices. After being connected by the electrical connection wiring, the control computer 1 gives the command signal and the system will start to work.

The working principle of the offshore crane heave compensation control system using visual ranging according to the present invention is as follows:

The control computer 1 is using as a controller. The industrial camera 2 using visual ranging detects the three-dimensional position information of the supply vessel. The direct pump control electro-hydraulic heave compensation device 3 is driven by the servo motor driver 4. As the executing device of the system, the rotation speed sensor 5, the three pressure sensors 6 and the built-in displacement sensor 7 collect the operating parameters of the direct pump control electro-hydraulic heave compensation device 3 and feed them back to the control system 1, as to achieve a closed-loop control of the direct pump control electro-hydraulic heave compensation device 3 in order to achieve loading up and down the cargo from the supply vessel by the offshore crane.

During the up stage, the industrial camera 2 detects the position of heave motion of vessel using visual ranging, the velocity and the accelerated velocity of the supply vessel is calculated by the control computer 1. The servo motor driver 4 drive the direct pump control electro-hydraulic heave compensation device 3 adds the movement of supply vessel with the same direction and amplitude to the offshore crane, in order to find the right time to loading up, avoiding impact load to the wire rope during the up stage.

During the down stage, the industrial camera 2 detects the position of heave motion of vessel using visual ranging, the velocity and the accelerated velocity of the supply vessel is calculated by the control computer 1. The servo motor driver 4 drive the direct pump control electro-hydraulic heave compensation device 3 adds the movement of supply vessel with the same direction and amplitude to the offshore crane, in order to load down the cargo to the supply vessel with the setting relative speed and find the right time to loading down to the supply vessel stably.

Embodiment 2

The present invention provides a direct pump control electro-hydraulic heave compensation device of the offshore crane heave compensation control system using visual ranging. The direct pump control electro-hydraulic heave compensation device 3 is used as an executing device of the offshore crane heave compensation control system. The direct pump control electro-hydraulic heave compensation device 3 includes a servo motor driver 4, a servo motor 16, a two-way hydraulic pump 17, an accumulator 13, a quick connector 14, two overflow valves 15, a single rod hydraulic cylinder 11, a movable pulley 9, a static pulley 10, at least three pressure sensors 6, a rotation speed sensor 5, and a displacement sensor 7. The servo motor driver 4 drives the servo motor 16 to rotate the two-way hydraulic pump 17. Two output terminals of the two-way hydraulic pump 17 are connected to a rod chamber and a rodless chamber of the single rod hydraulic cylinder 11 respectively through the hydraulic pipeline 12. The two output terminals of the two-way hydraulic pump 17 are in parallel with two overflow valves 15 which are reverse installed. The servo motor 16 is connected to the rotation speed sensor 5. The rotation speed sensor 5, the built-in displacement sensor 7, the servo motor driver 4, and three pressure sensors 6 are respectively connected to the control computer 1 via electrical connection wiring 8. The movable pulley 9 is connected to the piston rod of the single rod hydraulic cylinder 11. The static pulley 10 is connected to the bottom of the single rod hydraulic cylinder 11. The static pulley 10 is located at the same axis as the movable pulley 9. The movable pulley 9 and the static pulley 10 are connected to the crane lifting wire rope. The built-in displacement sensor 7 is installed in the single rod hydraulic cylinder 11.

The servo motor driver 4, the servo motor 16, the two-way hydraulic pump 17, the accumulator 13, the quick connector 14, the two overflow valves 15, the single rod hydraulic cylinder 11, the movable pulley 9, the static pulley 10, at least the three pressure sensors 6, the rotation speed sensor 5, the built-in displacement sensor 7 are integrated into an autonomous system. The system doesn't need any hydraulic oil source, reduces the number of components and the volume of devices. After being connected by the electrical connection wiring, the control computer 1 gives the command signal and the system will start to work.

The movable pulley 9, the piston rod of the single rod hydraulic cylinder 11 and the static pulley 10 of the direct pump control electro-hydraulic heave compensation device 3 are located at the same axis.

Figure 3:
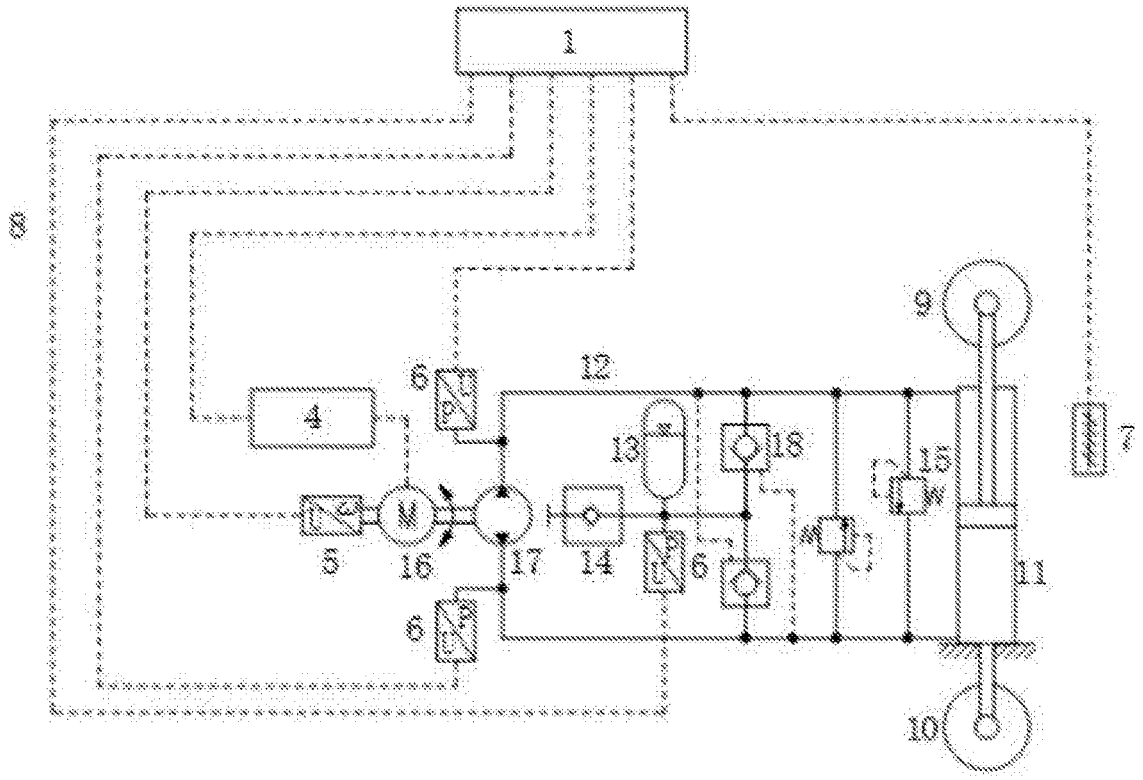
FIG. 3 is a structural diagram of a direct pump control type electro-hydraulic heave compensation device according to example 2.

Referring to FIG. 2 and FIG. 3, the first way of the accumulator 13 of the direct pump control electro-hydraulic heave compensation device 3 is connected to one output terminal of two pilot operated check valve 18 which are reverse installed, the other output terminal of two pilot operated check valve 18 which are reverse installed is in parallel with two output terminals of the two-way hydraulic pump 17.

The movable pulley 9, the piston rod of the single rod hydraulic cylinder 11 and the static pulley 10 are located at the same axis.

The two-way hydraulic pump 17, driven by the servo motor 16, performs the closed-loop control on the servo motor via the control computer 1, the servo motor driver 4, and the rotation speed sensor 5. The single rod hydraulic cylinder 11 is directly driven by the two-way hydraulic pump 17. By adjusting the rotation speed and direction of the servo motor 16, the direction of the flow of the two-way hydraulic pump 17 are controlled respectively, thereby driving the piston rod of the single rod hydraulic cylinder 11 to extend or retract.

The accumulator 13 compensate for the difference in flow caused by the unequal area difference between the two sides of the piston of the single rod hydraulic cylinder 11, and recovers energy. The quick connector 14 fills the oil to the accumulator 13 during inspection, as to supplement the oil loss and replace the waste oil. The two overflow valves 15 prevent the system from overpressure.

The rotation speed sensor 5, the three pressure sensors 6 and the built-in displacement sensor 7 collect the operating parameters of the direct pump control electro-hydraulic heave compensation device 3 and feed back to the control computer 1, as to control the closed-loop motion of the direct pump control electro-hydraulic heave compensation device 3.

The single rod hydraulic cylinder 11 is fixed to the base of the offshore crane. The movable pulley 9 is connected to the piston rod of a single rod hydraulic cylinder 11. The static pulley 10 is connected to the bottom of the single rod hydraulic cylinder 11, and is at the same axis as the movable pulley 9. The movable pulley 9 and the static pulley 10 are connected to the offshore crane with the wire rope.

Embodiment 3

Figure 4:
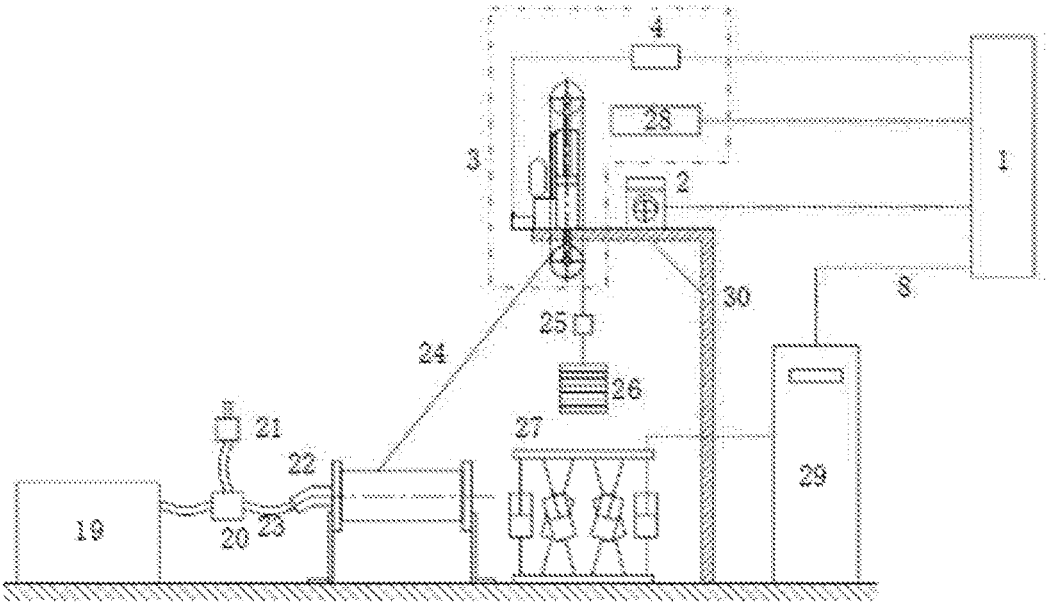
FIG. 4 is a structural diagram of a test platform of an offshore crane heave compensation control system using visual ranging.

Referring to FIG. 3, this is the second embodiment of the direct pump control electro-hydraulic heave compensation device 3 in the present invention. It includes a control computer 1, a servo motor driver 4, a servo motor 16, a two-way hydraulic pump 17, an accumulator 13, a quick connector 14, two overflow valves 15, a single rod hydraulic cylinder 11, a movable pulley 9, a static pulley 10, three pressure sensors 6, a rotation speed sensor 5, a displacement sensor 7, a hydraulic pipeline 12, electrical connection wiring 8 and two pilot operated check valves 18. The basic principle is the same as that in the embodiment 2 shown in FIG. 2. The direct pump control electro-hydraulic heave compensation device 3 can bear the negative load by two pilot operated check valve 18. The negative load means that the load drives the piston rod of the hydraulic cylinder to move. In FIG. 3, the negative load means that the piston rod of the single rod hydraulic cylinder 11 is pulled out by the external force. This working condition will not happen under the installation location as shown in FIG. 1 and FIG. 4. This structure which can bear the negative load, can guarantee the safety of the direct pump control electro-hydraulic heave compensation device 3 in the case of overload, can make the direct pump control electro-hydraulic heave compensation device 3 more flexible, and can increase the possibility of energy recovery.

Embodiment 4

Referring to FIG. 4, it is a testbed of the offshore crane heave compensation control system using visual ranging. It includes a hydraulic oil source 19, a hydraulic control valve 20, a control handle 21, a hydraulic winch 22, a direct pump control electro-hydraulic heave compensation device 3, a control computer 1, an industrial camera 2, a rack 30, a simulated load 26, a 6-DOF platform 27, a control cabinet for power distribution 29 and a tension sensor 25.

The direct pump control electro-hydraulic heave compensation device 3 and the industrial camera 2 are installed on the rack 30, one end of the wire rope 24 is connected with the simulated load 26 via the static pulley 10, movable pulley 9, tension sensor 25 of the direct pump control electro-hydraulic heave compensation device 3 with the simulated load 26, the other end of the wire rope 24 is connected with the hydraulic winch 22. The hydraulic control valve 20 respectively connects with the hydraulic oil source 19, the control handle 21 and the hydraulic winch 22, through the hydraulic pipeline 23. The simulated load 26 is loading up and down by the control handle 21. The simulated load 26 is placed on the 6-DOF platform 27, the 6-DOF platform 27 and the control cabinet for power distribution 29 combine together to simulate the vessel motion on the ocean. The control cabinet for power distribution 29, the sensor group 28, industrial camera 2 and servo motor driver 4 of the direct pump control electro-hydraulic heave compensation device 3 are connected with the control computer 1 respectively.

Referring to FIG. 2, the direct pump control electro-hydraulic heave compensation device 3 includes a servo motor driver 4, a servo motor 16, a two-way hydraulic pump 17, an accumulator 13, a quick connector 14, two overflow valves 15, a single rod hydraulic cylinder 11, a movable pulley 9, a static pulley 10, at least three pressure sensors 6, a rotation speed sensor 5, and a displacement sensor 7. The servo motor driver 4 drives the servo motor 16 to rotate the two-way hydraulic pump 17. Two output terminals of the two-way hydraulic pump 17 are connected to a rod chamber and a rodless chamber of the single rod hydraulic cylinder 11 respectively through the hydraulic pipeline 12. The two output terminals of the two-way hydraulic pump 17 are in parallel with two overflow valves 15 which are reverse installed. The servo motor 16 is connected to the rotation speed sensor 5. The rotation speed sensor 5, the built-in displacement sensor 7, the servo motor driver 4, and three pressure sensors 6 are respectively connected to the control computer 1 via electrical connection wiring 8. The movable pulley 9 is connected to the piston rod of the single rod hydraulic cylinder 11. The static pulley 10 is connected to the bottom of the single rod hydraulic cylinder 11. The built-in displacement sensor 7 is installed in the single rod hydraulic cylinder 11.

The servo motor driver 4, the servo motor 16, the two-way hydraulic pump 17, the accumulator 13, the quick connector 14, two overflow valves 15, single rod hydraulic cylinder 11, the movable pulley 9, the static pulley 10, at least three pressure sensors 6, the rotation speed sensor 5 and the built-in displacement sensor 7 are integrated into an autonomous device.

The movable pulley 9, the piston rod of the single rod hydraulic cylinder 11 and the static pulley 10 of the direct pump control electro-hydraulic heave compensation device 3 are located at the same axis.

the first way of the accumulator 13 of the direct pump control electro-hydraulic heave compensation device 3 is connected to one output terminal of two pilot operated check valve 18 which are reverse installed, the other output terminal of two pilot operated check valve 18 which are reverse installed is in parallel with two output terminals of the two-way hydraulic pump 17.

The testbed simulates the motion of a vessel in the marine environment by a six-degree-of-freedom platform 27, which simulates a conventional offshore crane operation with a fixed rack 30, a hydraulic winch 22, a hydraulic oil source 19, a hydraulic control valve 20, a control handle 21, and a simulated load 26. The industrial cameral, heave compensator 3 are mounted on the fixed rack 30. The system is powered by the control cabinet of power distribution 29, controlled by the control computer 1. The control computer 1 is collected the data.

The working principle of the testbed of the offshore crane heave compensation control system using visual ranging in the present invention is as follows:

The testbed can simulate and test the offshore crane operation process, perform testing, data recording and processing an offshore crane heave compensation motion control system using visual ranging. The sensor group 28 includes a pressure sensor 6, a rotation speed sensor 5, a displacement sensor 7 and so on. It can record the hydraulic system operating parameters, the posture of the 6-DOF platform 27, the impact of wire rope 24, and the direct pump control electro-hydraulic heave compensation device 3 and send them to the control system 1. The control system 1 controls the hydraulic pressure system, 6-DOF platform 27, and the direct pump control electro-hydraulic heave compensation device 3. The offshore platform is a fixed offshore platform.

The testbed of the offshore crane heave compensation motion control system using visual ranging can monitor the tension variation of the wire rope 24 connected between the simulated load 26 and the hydraulic winch 22 through the sensor group 28, as to study the control strategies and the impact comparison experiment of the offshore crane heave compensation motion control system using visual ranging.

What is claimed is:

1. An heave compensation control system using visual ranging for an offshore crane, comprising:

a detecting device, a controlling device and an actuating device, the heave compensation control system is configured to achieve heave motion compensation automatically while the offshore crane is loading down and up cargo to a supply vessel, by adding a movement with the same direction and same amplitude to the supply vessel;

wherein: the detecting device is configured to detect a three-dimensional position information of the supply vessel using a visual ranging method, and transmit the detected parameters of three-dimensional position information to the controlling device, the controlling device is configured to control the actuating device to achieve heave compensation movement automatically while the offshore crane is loading down and up the cargo to the supply vessel, by adding the movement with the same direction and amplitude to the supply vessel;

the offshore crane is positioned on a fixed offshore platform;

the three-dimensional position information means displacement, velocity and acceleration information in various directions which is referred to a rectangular coordinate system including the heave direction and the three-dimensional attitude of the supply vessel; and the movement with the same amplitude and same direction means the supply vessel moves along with a periodic motion of the ocean waves with the same amplitude and same direction.

2. The heave compensation control system of claim 1, wherein: during a loading up stage, the detecting device is configured detect heave motion information of the supply vessel using the visual ranging method, and the controlling device is configured to compute velocity and acceleration information of the supply vessel;

by adding the movement with the same amplitude and same direction to the supply vessel heave motion, the actuating device is configured to perform active heave motion compensation and choose a right time for loading up, so as to avoid impact loads of crane wire ropes.

3. The heave compensation control system of claim 1, wherein: during a loading down stage, the detecting device is configured to detect the three-dimensional position information of the supply vessel using the visual ranging method;

under the control of the controlling device, the actuating device is configured to add the movement with the same amplitude and same direction to the supply vessel during the loading down stage, to ensure that the cargo is down to a vessel deck of the supply vessel at a relative setting speed;

the actuating device is further configured to judge attitude information of the supply vessel and choose a right time for loading down, so as to load down the cargo steadily.

4. The heave compensation control system of claim 1, wherein: the actuating device is a direct pump control electro-hydraulic heave compensation device (3) comprising a servo motor driver (4), a rotation speed sensor (5), a displacement sensor (7), and at least three pressure sensors (6);

the servo motor driver (4) is configured to drive the direct pump control electro-hydraulic heave compensation device (3);

the rotation speed sensor (5), the displacement sensor (7), and the at least three pressure sensors (6) are configured to collect operating parameters of the direct pump control electro-hydraulic heave compensation device (3) and feed the collected operating parameters back to the controlling device for achieving a closed-loop control of the direct pump control electro-hydraulic heave compensation device (3), in order to load down and up the load steadily and stably.

5. The heave compensation control system of claim 4, wherein: the direct pump control electro-hydraulic heave compensation device (3) comprises the servo motor driver (4), a servo motor (16), a two-way hydraulic pump (17), an accumulator (13), a quick connector (14), two overflow valves (15), a single rod hydraulic cylinder (11), a movable pulley (9), a static pulley (10), the at least three pressure sensors (6), the rotation speed sensor (5), and the displacement sensor (7);

the servo motor driver (4) is configured to drive the servo motor (16) and therefore rotate the two-way hydraulic pump (17);

two output terminals of the two-way hydraulic pump (17) are connected to a rod chamber and a rodless chamber of the single rod hydraulic cylinder (11) respectively through a hydraulic pipeline;

two overflow valves, which are oppositely arranged, are connected in parallel between the two output terminals of the two-way hydraulic pump (17);

the servo motor (16) is connected to the rotation speed sensor (5);

the rotation speed sensor (5), the displacement sensor (7), the servo motor driver (4), and the at least three pressure sensors (6) are respectively connected to the controlling device which is a control computer (1);

the movable pulley (9) is connected to a piston rod of the single rod hydraulic cylinder (11);

the static pulley (10) is connected to a bottom of the single rod hydraulic cylinder (11);

the displacement sensor (7) is installed in the single rod hydraulic cylinder (11).

6. The heave compensation control system of claim 5, wherein: the servo motor driver (4), the servo motor (16), the two-way hydraulic pump (17), the accumulator (13), the quick connector (14), the two overflow valves (15), the single rod hydraulic cylinder (11), the movable pulley (9), the static pulley (10), the at least three pressure sensors (6), the rotation speed sensor (5), and displacement sensor (7) are integrated into an autonomous device.

7. The heave compensation control system of claim 5, wherein: the movable pulley (9), the piston rod of the single rod hydraulic cylinder (11) and the static pulley (10) of the direct pump control electro-hydraulic heave compensation device (3) are located on the same axis.

8. The heave compensation control system of claim 5, wherein: after a first way of the accumulator (13) of the direct pump control electro-hydraulic heave compensation device (3) is connected to a first terminal of the two pilot operated check valves (18) which are oppositely arranged, a second terminal of the two pilot operated check valves (18)

is connected in parallel between the two terminals of the two-way hydraulic pump (17).

9. The heave compensation control system of claim 5, wherein: the accumulator (13) is divided into three ways, the three ways comprises the first way, a second way and a third way; wherein the first way is connected to the rod chamber of the single rod hydraulic cylinder (11), the second way is connected to the quick connector (14), and the third way is connected to a first pressure sensor (6) of the at least three pressure sensors;

the at least three pressure sensors at least comprises the first pressure sensor, a second pressure sensor and a third pressure sensor; wherein the two output terminals of the two-way hydraulic pump (17) are respectively connected to the second pressure sensor (6) and the third pressure sensor (6).

10. The heave compensation control system of claim 1, wherein:

the controlling device is the control computer (1), the detecting device is an industrial camera (2), and the actuating device is a direct pump control electro-hydraulic heave compensation device (3);

the industrial camera (2) and the direct pump control electro-hydraulic heave compensation device (3) are connected to the control computer (1) via electrical connection wiring (8) respectively;

the industrial camera (2) and the direct pump control electro-hydraulic heave compensation device (3) are respectively mounted on an offshore crane base;

information and energy exchange is carried out between the direct pump control electro-hydraulic heave compensation device (3) and the control computer (1), which and forms a closed-loop motion control, in order to load down and up the load steadily and stably.

11. The heave compensation control system of claim 1, comprising a control method for controlling the heave compensation control system; wherein the control method includes the following steps:

detecting the three-dimensional position information of the supply vessel by the detecting device using visual ranging method;

transmitting the detected parameters of the three-dimensional position information of the supply vessel to the controlling device to control the actuating device to perform heave motion compensation while the offshore crane is loading up and down the cargo; and adding the movement with the same amplitude and same direction of heave motions to the supply vessel during the loading up stage and the loading down stage.

12. The heave compensation control system of claim 11, wherein the control method includes the loading up stage and the loading down stage;

during the loading up stage, the detecting device detects the heave motion information of the supply vessel using visual ranging method, and the controlling device computes the velocity and acceleration information of the supply vessel; by actuating device adds the motion of the same amplitude and same direction to the supply vessel, the actuating device performs active heave motion compensation and choose the right time for loading up, so as to avoid the impact loads of the crane wire ropes;

during the loading down stage, the detecting device detects the three-dimensional position information of the supply vessel using the visual ranging method; under the control of the controlling device, the actuating device adds the movement with the same amplitude and same direction to the supply vessel heave motion during the loading down stage, to ensure that the cargo is down to the vessel deck of the supply vessel at a relative setting speed;

the actuating device is further configured to judge the attitude information of the supply, and choose the right time for loading down, so as to load down the cargo steadily.

13. A testbed for the heave compensation control system of claim 1, wherein the testbed includes a hydraulic oil source (19), a hydraulic control valve (20), a control handle (21), a hydraulic winch (22), the actuating device, the controlling device, the detecting device, a rack (30), a simulated load (26), a 6-DOF platform (27), a control cabinet for power distribution (29) and a tension sensor (25);

the actuating device and the detecting device are installed on the rack (30), a first terminal of a wire rope (24) is connected to the simulated load (26) via the actuating device, a second terminal of the wire rope (24) is connected to the hydraulic winch (22);

the hydraulic control valve (20) is connected to the hydraulic oil source (19), the control handle (21) and the hydraulic winch (22) respectively;

the simulated load (26) is loaded up and down by the control handle (21);

the simulated load (26) is placed on the 6-DOF platform (27);

the 6-DOF platform (27) and the control cabinet for power distribution (29) are combined together to simulate the vessel motion of the supply vessel on the ocean;

the control cabinet for power distribution (29), actuating device and detecting device are connected to the controlling device respectively.

14. The testbed of claim 13, wherein the actuating device is the direct pump control electro-hydraulic heave compensation device (3), including a servo motor driver (4), a rotation speed sensor (5), a displacement sensor (7), and at least three pressure sensors (6).

15. The testbed of claim 14, wherein the actuating device is the direct pump control electro-hydraulic heave compensation device (3) includes the servo motor driver (4), the servo motor (16), a two-way hydraulic pump (17), an accumulator (13), a quick connector (14), two overflow valves (15), a single rod hydraulic cylinder (11), a movable pulley (9), a static pulley (10), the at least three pressure sensors (6), the rotation speed sensor (5), and the displacement sensor (7);

the servo motor driver (4) is configured to drive the servo motor (16) and therefore rotate the two-way hydraulic pump (17);

two output terminals of the two-way hydraulic pump (17) are connected to a rod chamber and a rodless chamber of the single rod hydraulic cylinder (11) respectively through a hydraulic pipeline;

the two oppositely mounted overflow valves, which are oppositely arranged, are connected in parallel between the two output terminals of the two-way hydraulic pump (17);

the servo motor (16) is connected to the rotation speed sensor (5);

the rotation speed sensor (5), the displacement sensor (7), the servo motor driver (4), and the at least three pressure sensors (6) are respectively connected to the controlling device which is a control computer (1);

the movable pulley (9) is connected to a piston rod of the single rod hydraulic cylinder (11);

the static pulley (10) is connected to a bottom of the single rod hydraulic cylinder (11);

the displacement sensor (7) is installed in the single rod hydraulic cylinder (11).

16. The testbed of claim 14, wherein the controlling device is a control computer (1), and the detecting device is an industrial camera (2));

the industrial camera (2) and the direct pump control electro-hydraulic heave compensation device (3) are connected to the control computer (1) via electrical connection wiring (8) respectively.

17. The testbed claim 16, wherein a sensor group (28), the industrial camera (2), and the servo motor driver (4) in the direct pump control electro-hydraulic heave compensation device (3) are connected to the control computer (1), respectively.

18. The testbed claim 14, wherein a first terminal of a wire rope is connected to a simulated load (26) through the static pulley (10), the movable pulley (9) and a tension sensor (25) in the direct pump control electro-hydraulic heave compensation device (3), and a second terminal of the wire rope (24) is connected to the hydraulic winch (22).

19. A direct pump control electro-hydraulic heave compensation device using the heave compensation control system of claim 1, wherein the direct pump control electro-hydraulic heave compensation device (3) is the actuating device of the heave compensation control system;

the direct pump control electro-hydraulic heave compensation device (3) comprises a servo motor driver (4), a servo motor (16), a two-way hydraulic pump (17), an accumulator (13), a quick connector (14), two overflow valves (15), a single rod hydraulic cylinder (11), a movable pulley (9), a static pulley (10), at least three pressure sensors (6), a rotation speed sensor (5), and a displacement sensor (7);

the servo motor driver (4) is configured to drive the servo motor (16) and therefore rotate the two-way hydraulic pump (17);

two output terminals of the two-way hydraulic pump (17) are connected to a rod chamber and a rodless chamber of a single rod hydraulic cylinder (11) respectively;

the two overflow valves, which are oppositely arranged, are connected in parallel between the two output terminals of the two-way hydraulic pump (17);

the servo motor (16) is connected to the rotation speed sensor (5);

the rotation speed sensor (5), the displacement sensor (7), the servo motor driver (4), and the at least three pressure sensors (6) are respectively connected to the controlling device which is a control computer (1);

the movable pulley (9) is connected to a piston rod of the single rod hydraulic cylinder (11);

the static pulley (10) is connected to a bottom of the single rod hydraulic cylinder (11); and the displacement sensor (7) is installed in the single rod hydraulic cylinder (11).

20. The direct pump control electro-hydraulic heave compensation device of claim 19, wherein after a first way of the accumulator (13) of the direct pump control electro-hydraulic heave compensation device (3) is connected to a first terminal of two pilot operated check valves (18) which are mounted oppositely, a second terminal of the two pilot operated check valves (18) is connected in parallel between the two terminals of the two-way hydraulic pump (17).

* * * * *